US009415422B2

(12) United States Patent
Worth, II et al.

(10) Patent No.: US 9,415,422 B2
(45) Date of Patent: Aug. 16, 2016

(54) MAIL SORTING SYSTEM

(75) Inventors: Floyd W. Worth, II, Richardson, TX (US); James M. Pippin, Keller, TX (US); Dale E. Redford, Grand Prairie, TX (US); Heribert Stumpf, Rye, NY (US)

(73) Assignee: Siemens Industry, Inc., Alpharetta, GA (US)

( * ) Notice: Subject to any disclaimer, the term of this patent is extended or adjusted under 35 U.S.C. 154(b) by 1922 days.

(21) Appl. No.: 11/716,200

(22) Filed: Mar. 9, 2007

(65) Prior Publication Data

US 2007/0209976 A1 Sep. 13, 2007

Related U.S. Application Data

(60) Provisional application No. 60/781,018, filed on Mar. 10, 2006.

(51) Int. Cl.
*G06K 9/00* (2006.01)
*B07C 3/08* (2006.01)

(52) U.S. Cl.
CPC ..... *B07C 3/08* (2013.01)

(58) Field of Classification Search
CPC ..... B07C 3/00; B07C 3/02; B07C 3/06; B07C 3/08; B07C 3/085; B07C 5/3412
USPC ..... 209/583, 584, 900
See application file for complete search history.

(56) References Cited

U.S. PATENT DOCUMENTS

| | | | | |
|---|---|---|---|---|
| 5,794,534 | A | 8/1998 | Enderlein et al. | |
| 5,901,855 | A * | 5/1999 | Uno et al. | 209/584 |
| 7,464,822 | B2 * | 12/2008 | Coffelt et al. | 209/559 |
| 7,589,294 | B2 * | 9/2009 | Burns et al. | 209/584 |
| 2004/0007510 | A1 * | 1/2004 | Kechel | 209/584 |
| 2006/0122858 | A1 | 6/2006 | Miles et al. | 708/1 |
| 2006/0144763 | A1 * | 7/2006 | Coffelt et al. | 209/584 |
| 2007/0151904 | A1 * | 7/2007 | Hanson et al. | 209/584 |
| 2007/0226088 | A1 | 9/2007 | Miles et al. | 705/28 |
| 2008/0154751 | A1 | 6/2008 | Miles | 705/28 |

FOREIGN PATENT DOCUMENTS

| | | | |
|---|---|---|---|
| DE | 100 39 394 | C1 | 9/2001 |
| WO | WO 03/011484 | A1 | 2/2003 |
| WO | WO 2006/100484 | A1 | 10/2006 |

* cited by examiner

*Primary Examiner* — Joseph C Rodriguez
*Assistant Examiner* — Kalyanavenkateshware Kumar

(57) ABSTRACT

A method for sorting mail pieces includes the steps of loading mail pieces to be sorted into individual holders, sorting the holders using an automated system that stores and reorders the holders so that the holders are ordered according to a sort scheme for the mail pieces, storing the sorted holders in a storage area during sorting, and then unloading the mail pieces from the holders in order according to the sort scheme. The storage step occurs during sorting in the sense that a series of reordered holders is gradually created in one of a variety ways by the sorting process, and a storage area is provided for this purpose. Preferably the method further includes steps of unloading the sorted holders from the storage area and transporting the holders to an unloading station at which the unloading step is carried out.

16 Claims, 12 Drawing Sheets

MAIL SORTING SYSTEM

This application claims priority of U.S. Provisional Application No. 60/781,018, filed Mar. 10, 2006.

TECHNICAL FIELD

The invention relates to mail sorting systems, in particular to systems for sorting mail pieces having an address that cannot be decoded using conventional OCR or bar code scanning, or that cannot be machine sorted due to the physical characteristics of the mail pieces.

BACKGROUND

Residual mail is a term used to refer to postal mail remaining after most of the mail to be delivered has been sorted to delivery order by automated sorting machines. Letters are currently sorted automatically by a variety of known systems such as DBCS (delivery bar code sorter), MLOCR (multi-line optical character reader) and the like. The USPS has recently funded the development of a sorting system for flats (mail pieces between 11½ and 15 inches long, or between 6⅛ and 12 inches high, or between ¼ and ¾ inch thick), which has the aim of accomplishing automated sorting of flats to delivery groups that correspond to the groups created by automated letter sorting machines. However, even with automation of both letter sorting and flats sorting, some mail pieces will still comprise manual mail that must be sorted by hand rather than by a sorting machine.

Such residual mail may include mail for which the address cannot be decoded by Optical Character Recognition (OCR) or bar code scanning, and mail which cannot be machine sorted due to its physical characteristics such as too stiff, irregular shapes, too thin and open folds. Manual casing refers to the process currently carried out by postal carriers wherein mail that has not been presorted to delivery order is manually sorted to a plurality of slots in a sorting case, where each slot represents a delivery destination. The cased mail is then removed from the slots ("pulled down") and eventually merged with presorted mail. Where flats and letters have each been presorted, the carrier takes mail from three separate stacks, letters, flats and manual mail, when delivering the mail. The time required for the casing operation combined with the need to merge stacks of presorted mail greatly slows down the manual delivery of mail.

Pitney-Boyes PCT publication WO 2006110486 describes a concept of removing multiple feeders from multiple sorters and providing a pathway from each feeder to each sorter enables fewer feeds per mail piece for conventional sorters. This system includes a plurality of feeders, and a plurality of sorters configured to receive and sort the mail pieces from the feeders. The bins are sorted mail stations, and the feeders are feeding stations. Clamps are used for holding the mail pieces during sortation to expedite the proper movement of mail pieces from the feeders to appropriate sorter bins. However, use of mechanical devices such as clamps to hold mail during sorting is likely to prove difficult.

The mail handling system of the present invention has the goal of making it possible to machine-sort residual mail. The system can be used to sort mail pieces of all types from postcards up to large flats. When used in combination with letter and flats sorting processes, the need to merge mail remains, but the manual casing operation can be virtually eliminated. To further reduce merge operations, the system can be used to sort both residual flats and residual letters.

SUMMARY OF THE INVENTION

A method for sorting mail pieces according to the invention includes the steps of loading mail pieces to be sorted into individual holders, sorting the holders using an automated system that stores and reorders the holders so that the holders are ordered according to a sort scheme for the mail pieces, storing the sorted holders in a storage area during sorting, and then unloading the mail pieces from the holders in order according to the sort scheme. The storage step occurs during sorting in the sense that a series of reordered holders is gradually created in one of a variety ways by the sorting process, and a storage area is provided for this purpose. Preferably the method further includes steps of unloading the sorted holders from the storage area and transporting the holders to an unloading station at which the unloading step is carried out.

Such a method can be used as part of a larger scale sorting method which deals with both machineable and non-machineable mail. Such a process includes the steps of sorting a majority of the mail pieces using an automated sorting system such as a DBCS or MLOCR machine, sorting residual mail not sortable on the automated sorting system by the steps given above, and merging the mail pieces sorted with the automated sorting system with the sorted residual mail. In this case, the "residual mail" by definition means mail left over from the conventional automated sorting machine which, due to its physical characteristics, cannot be processed by that machine.

The invention further provides an apparatus for sorting mail pieces, especially residual mail, according to the foregoing methods. Such a system includes at least one loading station at which mail pieces to be sorted are loaded into individual holders, and a conveyor system that includes conveyor sections that transport holders containing mail pieces from the loading station to a splitter that diverts each holder to one of a set of conveyor lanes based on a sort scheme, thereby dividing the holders up into subgroups based on the sort scheme. An ordering system receives the holders from the conveyor system and includes a plurality of holder reordering devices that each receive a designated subgroup of the mail pieces and reorder that subgroup according to the sort scheme. An unloader receives the holders from the reordering system and removes the mail pieces from the holders in order according to the sort scheme, after which the mail pieces may be loaded into trays or packaged for delivery.

According to a further aspect of the invention, a mail sorting system according to the invention includes a control computer and a plurality of holders configured for receiving and holding mail pieces therein. At least one holder loading station is provided for loading the holders with mail pieces, the holder loading station including an input device for inputting destination data for the mail pieces to the control computer. A plurality of totes are configured to receive and transport groups of holders. A conveyor system includes a first conveyor for directly transporting holders containing mail pieces in series, and a second conveyor configured to transport the totes to different locations in the mail sorting system. At least one tote loading station is provided that includes a loading mechanism that loads holders into totes. An ordering track receives and supports the holders containing mail pieces and is provided with a mechanism for reordering holders on the track according to a sort scheme. The system further has an unloading station including an unloading mechanism that removes mail pieces from the holders and a traying device that places the unloaded mail pieces in mail trays.

In a preferred form of the foregoing embodiment, the input device used at the holder loading station is typically a keyboard and video display for allowing manual input of destination data for the mail pieces to the control computer that stores the destination information for the mail piece and associates it with the identification number of the holder. The holders, each containing one mail piece, are loaded into the totes at the tote loading station. Holders are loaded into a particular tote according to sort scheme. The sort scheme is configured so as to relate each tote load station to a particular ordering tracks. The loaded totes are then conveyed by the conveying system to an induction station where the holders are transferred to an ordering track such as a carousel or linear track. The control system diverts the loaded totes to one of several ordering tracks according to the sort scheme. A robot or transfer mechanism reorders the resulting subgroups of holders according to a sort scheme for each track, after which the holders are removed from the track in order. The sorted holders may be loaded into totes and conveyed from the ordering track to a traying station. At the traying station, the holders are removed from the totes, and the mail pieces removed from the holders. The mail pieces are then loaded into mail trays in order according to the sort scheme. The timing and sequence of these operations may vary as described further below. These and other aspects of the invention are discussed further in the detailed description that follows.

BRIEF DESCRIPTION OF THE DRAWINGS

In the accompanying description, wherein like numerals represent like elements.

DETAILED DESCRIPTION

Figure 1:
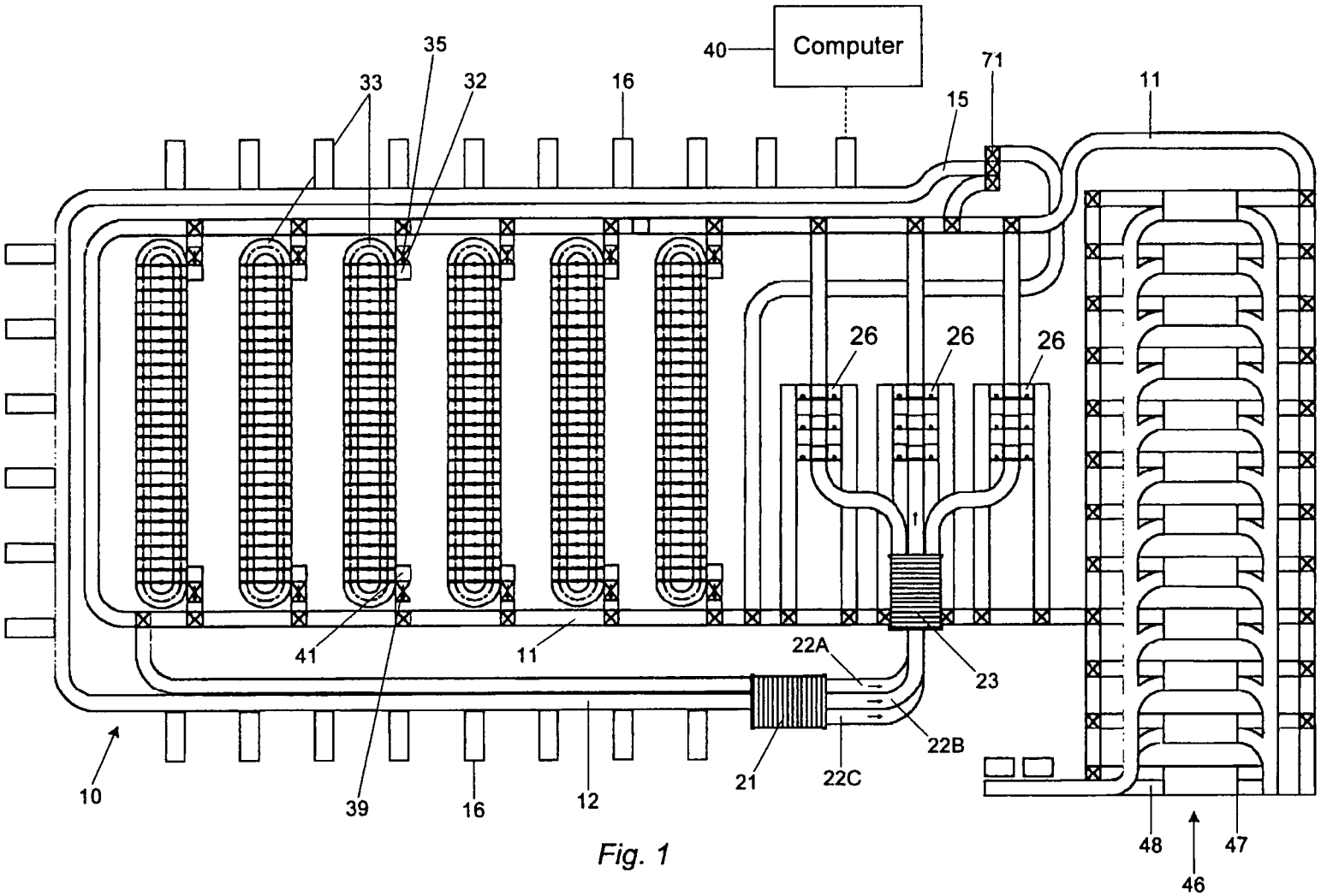
FIG. 1 is a schematic diagram of a mail sorting system according to the invention.
Figure 2:
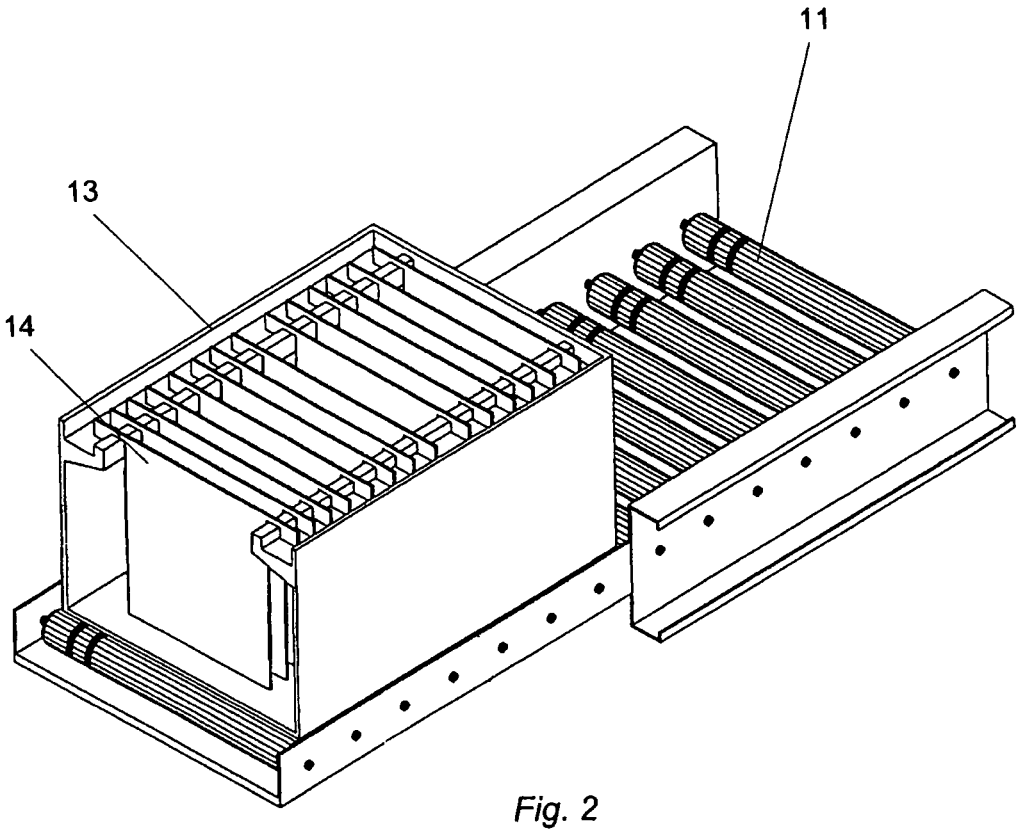
FIG. 2 is a perspective view of a tote and holders according to the invention on a conveyor section.

Referring to FIGS. 1-2, a system 10 according to the invention includes a number of sorting stations interconnected by conveyors such as Tricon® roller conveyor sections 11 and brush conveyor sections 12. A series of totes 13 resembling file drawers open on one or both ends are used to transport a number of mail piece holders 14 along conveyor sections 11 during certain stages of the process, whereas at other times holders 14 are transported directly on brush conveyors 12. This makes it possible to build system 10 in a manner consistent with factory automation principles, where components of the system may be in different locations rather than grouped together as in the embodiment shown.

Holders 14 are, in the simplest embodiment, no more than light weight folders with upper end hangers similar to commercially available file folders. In a more advanced embodiment, holders 14 are double-walled devices capable of being peeled away from the mail piece inside using cancellation of relative motion comparable to that used by the H-belt disclosed in Pippin U.S. patent application Ser. No. 10/142,348, filed May 19, 2002, Publication No. 20030038065, Feb. 27, 2003, the contents of which are incorporated by reference herein. Holders 14 according to the invention could also include mechanical devices such as clamps used to hold mail.

Empty holders 14 are carried past a series of manual loading stations 16 on a rail 15. Empty folders and previously filled folders are simultaneously pushed along by a brush conveyor 12 located above and at the ends of the folders. Bar code scanners are located at each load station 16. The scanner reads the bar code located on each holder 14 as they pass by respective load stations 16. Holder 14 load status is determined by correlating the holder 14 bar code with a computer data base. An empty holder 14 is stopped for loading following key coding of destination information for the mail piece by the operator. Bar coded holder 14 and the system at the station 16 automatically store the bar code and associates the keyed address information with the holder. This mail piece information and now related holder bar code is used later for sorting. Station 16 may include a camera and video display for presenting the operator with an enlarged image of the mail piece to facilitate entry of destination information for the mail piece.

Mail entering system 10 is directed to destinations in delivery zones served by the processing center at which system 10 is located. Holders 14, each loaded with a single mail piece, are conveyed from each station 16 by exit brush conveyor 12 that carries the holders 14 one at a time to a three-way switch or splitter 21. In one embodiment, splitter 21 is a three position, shifting frame mechanism that moves a holder 14 from the conveyor 12 to either right or left lanes 22A, 22C, or leaves it in the center lane 22B as the brush drive moves the holder along. A bar code reader positioned at splitter 21 scans holders 14 such that the holders are diverted to one of lanes 22 in accordance with a predetermined sort scheme.

As shown in FIGS. 3A-3C and 4, one example of a splitter 21 comprises a row of shifting frame sections 200 including a left frame 201, center frame 202 and right frame 203 united by connectors 204 to move in unison. In the position shown in FIG. 3A, the center frame 202 is shown in alignment with the incoming brush conveyor 12. Center frame 202 forms a thru-lane for holders 14 that are destined to remain in lane 22B or which will be shifted left or right by a downstream section 200 as explained further below. Each section 200 is mounted to slide along a support bar 206. The left and right frames 201, 203 are preferably provided with movable stop or gate assemblies 209. Each stop assembly 209 includes a pair of lateral anchor tabs 211 projecting outwardly from opposite outer sides of the associated frame section 201 or 203. Tabs 211 are connected by a pair of coil springs 212 to opposite ends of a horizontal crossbar 213. Crossbar 213 extends all the way across frame 201, 203 near its lower end and through elongated grooves 214 in the sidewalls 216 of each frame. A pair of vertical bars 217 located along the insides of sidewalls 216 are connected at or near their lower ends to crossbar 213 and extend upwardly through holes in a horizontal shoulder portion 218 of sidewalls 216.

Holders 14 in this example each comprise a double-walled plastic bag suspended from a pair of parallel horizontal hanger bars 55. The continuation of brush conveyor 12 is three such brush conveyors 12A, 12B, 12C side by side, one for each sorting lane. It is most economical to run brush conveyors 12 constantly rather than using a start/stop cycle. To keep each holder 14 in place during a sideways shift, the upper ends of bars 217 engage the outer ends of hangers 55 and crossbar 213 stops the lower end of the holder 14 and prevents it from swinging or moving downstream. Between shifts, a suitable actuator (e.g., an L-shaped projection or hook actuated by a solenoid) engages bars 217 without blocking movement of holders 14 and pushes crossbar 213 down, or pulls crossbar 213 down, stretching springs 212. In this position, holders 14 continue to move under the action of brush conveyors 12A-12C to the next shifting frame section 201, 203, or to the takeaway lanes 22A-22C. Upon disengagement of the actuator, springs 212 contract and return crossbar 213 and bars 217 to the closed position for the next cycle.

Figure 3A:
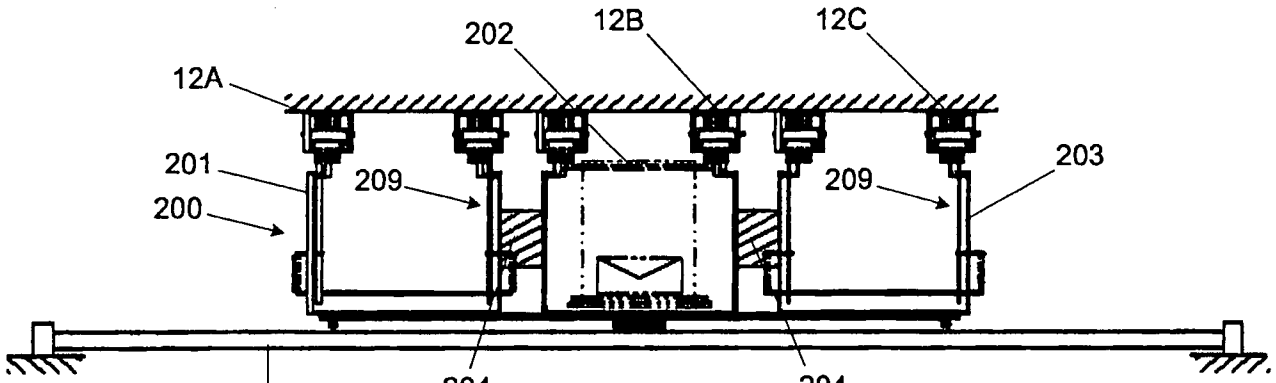
FIGS. 3A-3C are a series of elevation views of a splitter mechanism according to the invention.
Figure 3B:
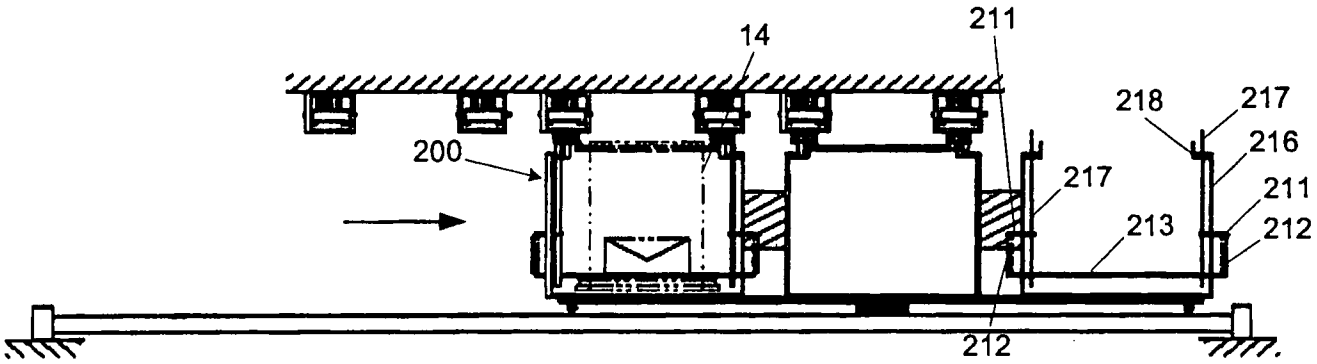
Figure 3C:
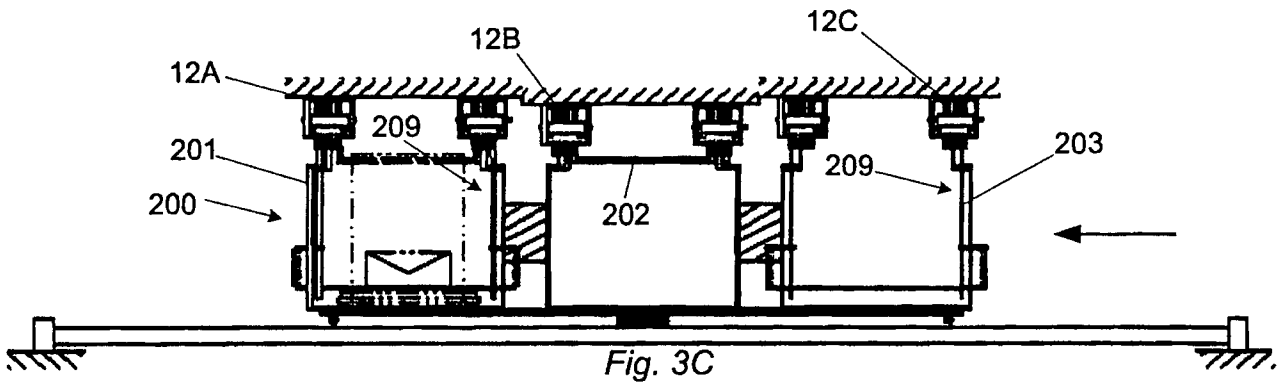

In FIG. 3B, shifting frame 200 moves to the right so that frame section 201 receives an incoming holder from the from the brush conveyor 12. Stop assemblies 209 are in the closed position. Frame 200 then shifts back to the left (FIG. 3C) and stop assemblies 209 are opened so that the holder 14 in frame section 201 moves on. The cycle can then be repeated as needed. The directions in which frame 200 shifts are reversed to load a holder 14 into frame section 203. If the holder 14 entering frame 200 is destined to remain in the center lane beneath conveyor 12B, then it continues moving and no shift of frame 200 occurs.

Figure 5B:
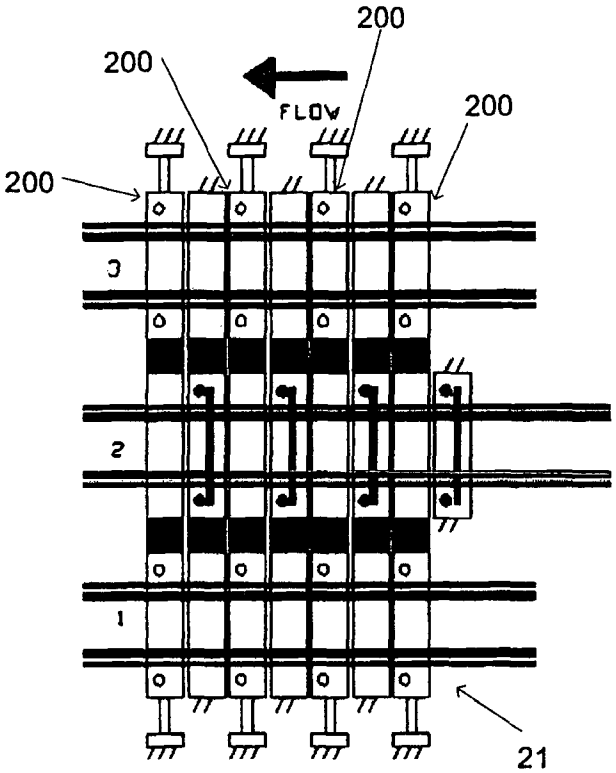
FIGS. 5A to 5D are a series of views of a multiple shifting frame mechanism according to the invention at different stages of operation.
Figure 5A:
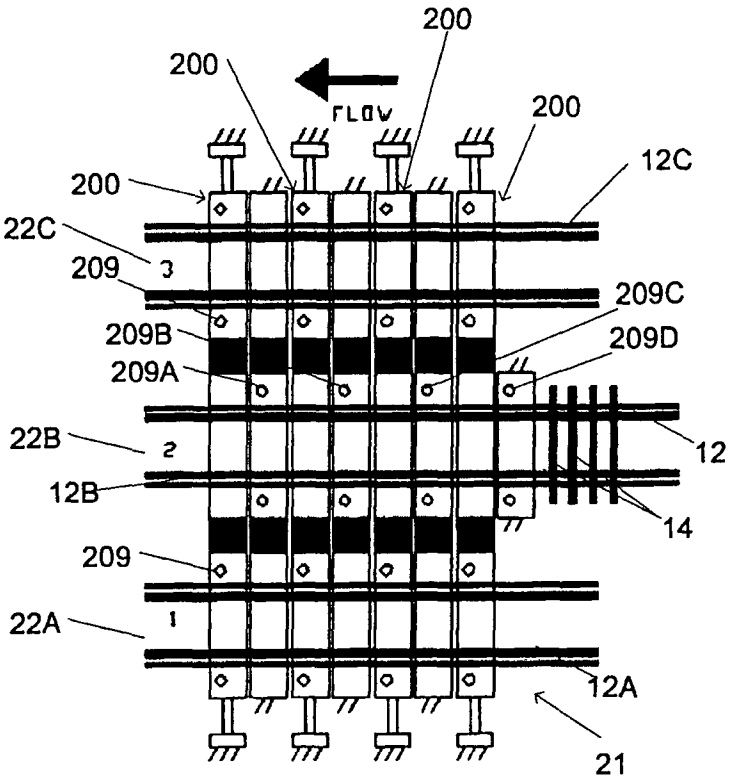

The foregoing example can operate with only one shifting frame 200. However, it can be adapted to load multiple holders at a time by permitting several holders 14 to enter a center lane formed from a series of frames 200 operating side by side. In the example of FIGS. 5A-5D, four shifting frames 200 are mounted side by side but spaced from each other. Stop gates 209 are provided in the center lane 22B between middle frame sections 202 as shown. Loading of holders 14 starts with the forwardmost gate 209A in the closed position and the other gates 209 between sections 202 in the open position. A holder 14 enters from brush conveyor 12 and is conveyed by conveyor 12B to the forwardmost gate 209A. A sensor such as a photocell or proximity switch detects the arrival of the first holder 14, whereon the next gate 209B is closed. A second holder 14 then enters lane 22B and continues moving until it contacts gate 209B. The cycle is then repeated a third time, this time with the third gate 209C closed. Then the entry gate 209D is closed and a fourth holder 14 is brought into position against it as shown in FIG. 5B.

Figure 5D:
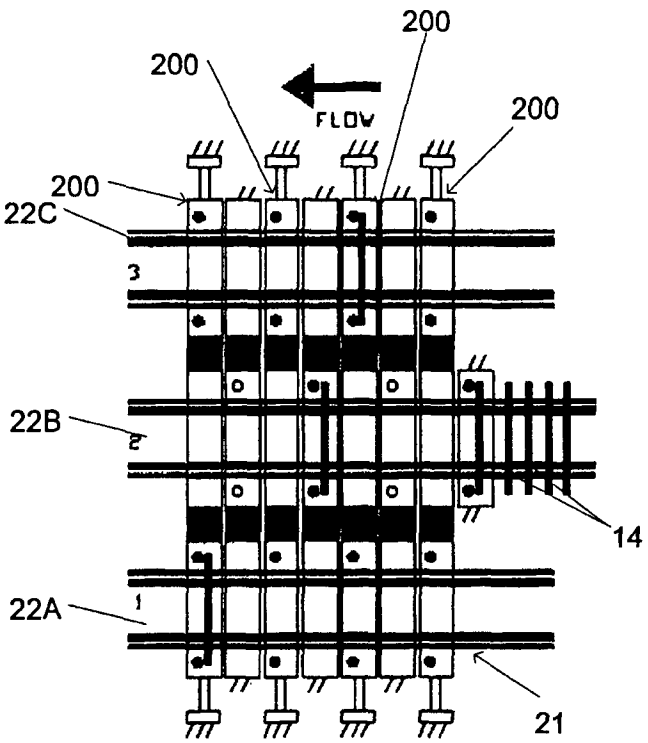
Figure 5C:
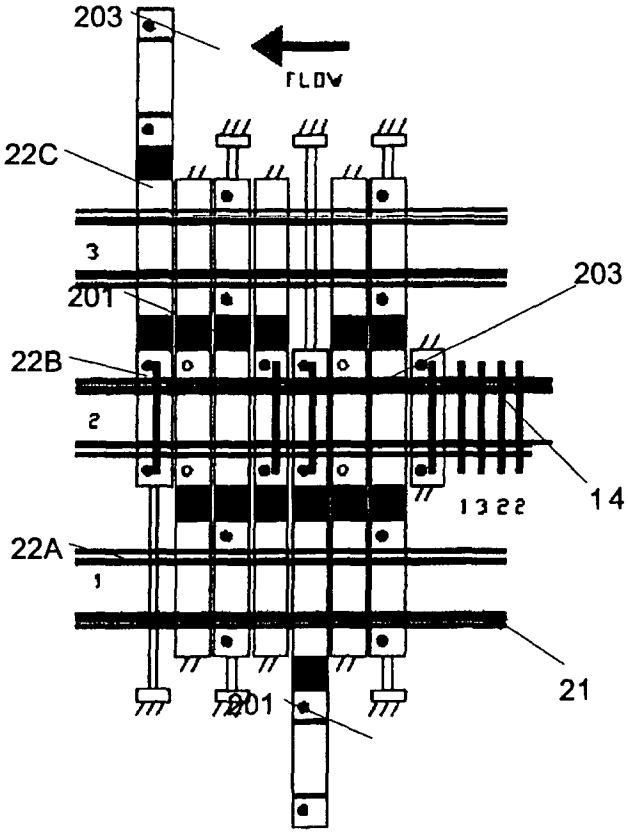

Once four holders 14 are in contact with gates 209A-209D, the frames 200 are shifted in accordance with the sort scheme and the read destination information from each of the four holders 14. For example, if the holder 14 at gate 209A needs to go to lane 22A, that frame 200 in front of it would shift to the right as shown in FIGS. 2A-2C. The other three frames 200 might shift in the same or opposite direction, or might not shift if the mail piece in the holder 14 should remain in the center lane 22B. Once the frames 200 have shifted, gates 209A-209D that feed into a shifted frame 200 (i.e., into either of the outer frame sections 201, 203) open, while any of gates 209A-209D that adjoin an unshifted frame 200 remain closed as shown in FIG. 5C. The action of brush conveyors 12A-12C moves holders 14 into frame sections 201, 203. The gates 209 which are built into the frame sections 201, 203 are in the closed position at this time. Once the affected holders 14 have entered the respective frame sections 201, 203, any frame 200 that was shifted is then shifted back to its original position (FIG. 5D). All gates 209 are then opened so that all four of the holders 14 move out of the splitter through one of the lanes 22A-22C. The cycle can then be repeated by closing all gates except 209B-209D and starting the loading process over again.

Figures 6A, 6B:
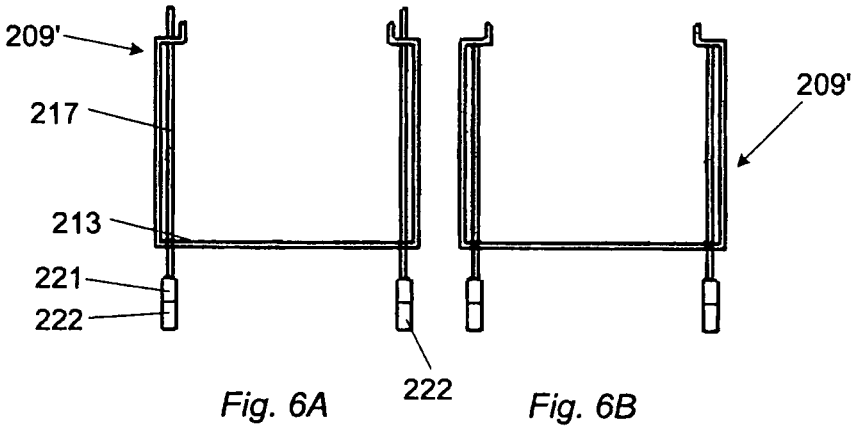
FIGS. 6A and 6B are front views of a gate mechanism according to the invention in closed and open states respectively.

A modified form of stop gate 209' useful in the foregoing embodiment is shown in FIGS. 6A, 6B. The lower ends of bars 217 extend past horizontal crossbar 213 and are secured by couplings 221 to solenoids 222, which are actuated and deactuated to raise and lower the gate 209'.

A batch switching process such as the foregoing provides the system with greater throughput speed and is this preferred over a simple one frame splitter. Whether a single or multiple frame embodiment is contemplated, the destination information on each frame entering the frame 200 must be known, such as by using a scanner mounted near the point of entry to the splitter 21. The control computer then operates the shifting frame(s) 200 on the basis of the sort scheme.

Each lane 22 from the first splitter 21 carries holders 14 to three associated secondary splitters 23, which operate in the same manner as splitter 21. In this example the secondary splitters 23 are vertically stacked such that only the top splitter 23 is visible in FIG. 1. Lanes from splitters 23 lead to nine associated tote loaders 26 wherein each holder 14 is again shifted left or right and then pushed into an open tote 13 positioned to receive it by a combination of a right angle transfer mechanism such as described above in connection with switch 21 and overhead brush drives, following an L-shaped path. For economy, the loaders 26 are arranged as three stacks of three each, similarly to splitters 23. At this stage, system 10 has subgroups of sorted mail contained in holders 14 down to the level of a single tier of the carousel units described below, corresponding to a range of destination points. Thus, mail in each tote 13 is directed to a destination in a predefined range, but is not yet in delivery order.

Figure 7:
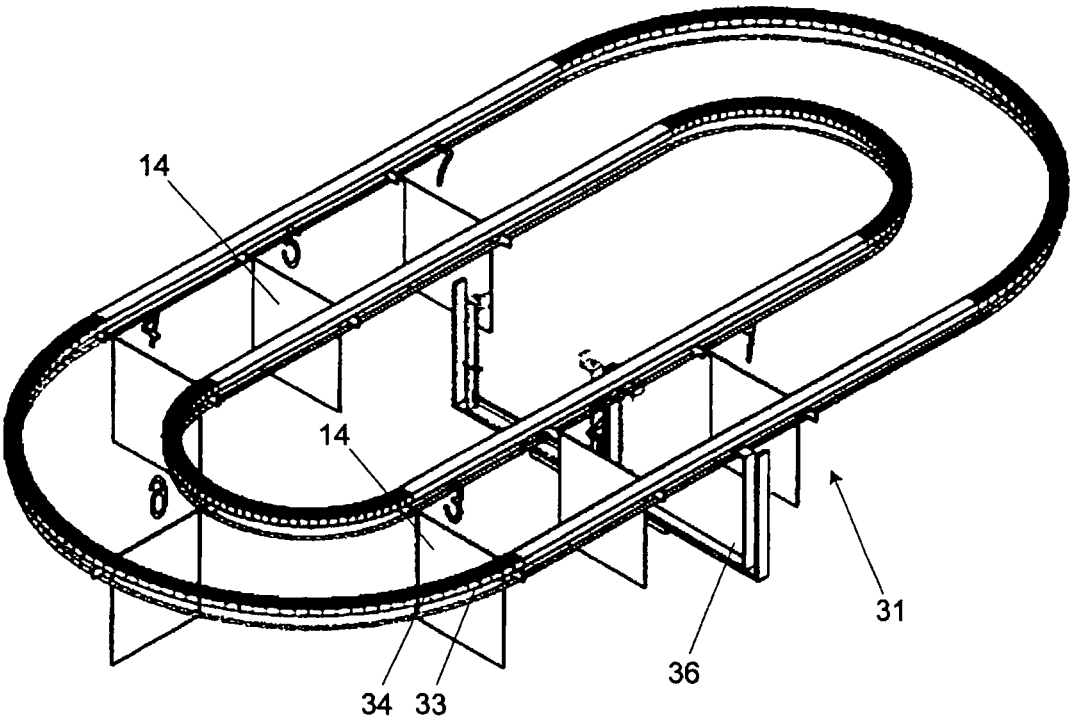
FIG. 7 is a partial perspective view of a sorting carousel according to the invention whereon holders carrying mail pieces are ordered according to a sort scheme.

Referring to FIGS. 1 and 7, a fully loaded tote 13 is automatically or manually removed from loader 26 and conveyed through a series of conveyor sections 11 and elevators 35 to a destination level of one or more carousels 31, which function to reorder holders 14. Holders 14 from the tote 13 are unloaded one at a time at an induction mechanism 32 and begin moving along an oval-shaped track 33 under the action of a brush conveyor 34. A control computer 40 is connected to a bar code reader positioned adjacent track 33 which scans the bar codes on holders 14 moving about carousel 31 and compares the order in which the holders appear with a sort scheme order. The sort scheme will normally require all holders 14 carrying mail pieces destined for the same destination to be grouped consecutively.

To re-order holders 14, a right angle transfer mechanism 36 positioned inside track 33 engages a shifting track section that carries a holder therein to a center position inside of the track 33. Movement of holders 14 along track 33 continues until the control system determines that the withdrawn holder should be reinserted by mechanism 36 in a new position relative to the other holders on track 33. Several transfer mechanisms 36 can be placed inside of track 33 so that several holders 14 can be withdrawn and reinserted at the same time, increasing the throughput of the system.

The algorithm for reordering holders 14 may be one which keeps track of the current order of all holders 14 on track 33 and reinserts the withdrawn holder 14 at a position where it is grouped with a series of other holders containing mail addressed to the same destination. A sensor scans each holder 14 as it passes by on track 33, enabling control computer 40 to keep track of the order in which the holders appear. It may be necessary to provide several sensors for this purpose, one for each transfer mechanism 36.

Once a tote 13 has been emptied at induction mechanism 32, it is lowered by the elevator 35 and continues along the return run of conveyor 11 for reloading into a tote loader 26. The control system keeps track of full and empty slots in tote loaders 26 and directs empty totes accordingly. Tote loaders 26 also function as a storage rack for empty totes 13 not currently in use. The number of empty totes to be stored increases as the sorting process winds to completion.

At the end of the sorting process, the carousel levels are full of holders 14, and the holders are in carrier delivery order. Empty totes 13 are then unloaded from tote loaders 26 and carried along conveyor 11 to loading elevators 39 adjacent each carousel 31. An empty tote 13 is brought into position on elevator 39, and holders 14 are loaded into each tote 13 by sideways transfer using an unloading mechanism 41 similar to that used at loading stations 26, one at a time or in batches. Holders 14 are unloaded from each carousel 31 in carrier delivery order. The ID codes of totes 13 used for each carousel are tracked by the control system. Full totes 13 are returned to conveyor 11 and carried to a series of traying stations 46. The control system reads the ID tag on the tote 13 and directs it to the station 46 assigned to that carousel 31. Totes 13 arrive in the order in which they were unloaded, which corresponds to delivery order.

Figure 4:
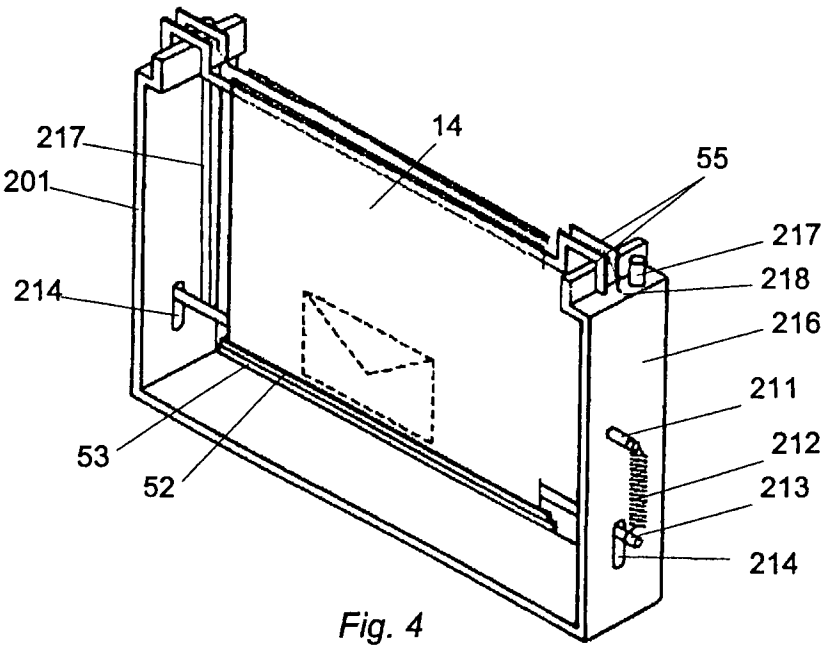
FIG. 4 is a perspective view of shifting frame section of FIGS. 3A-3C.
Figure 8:
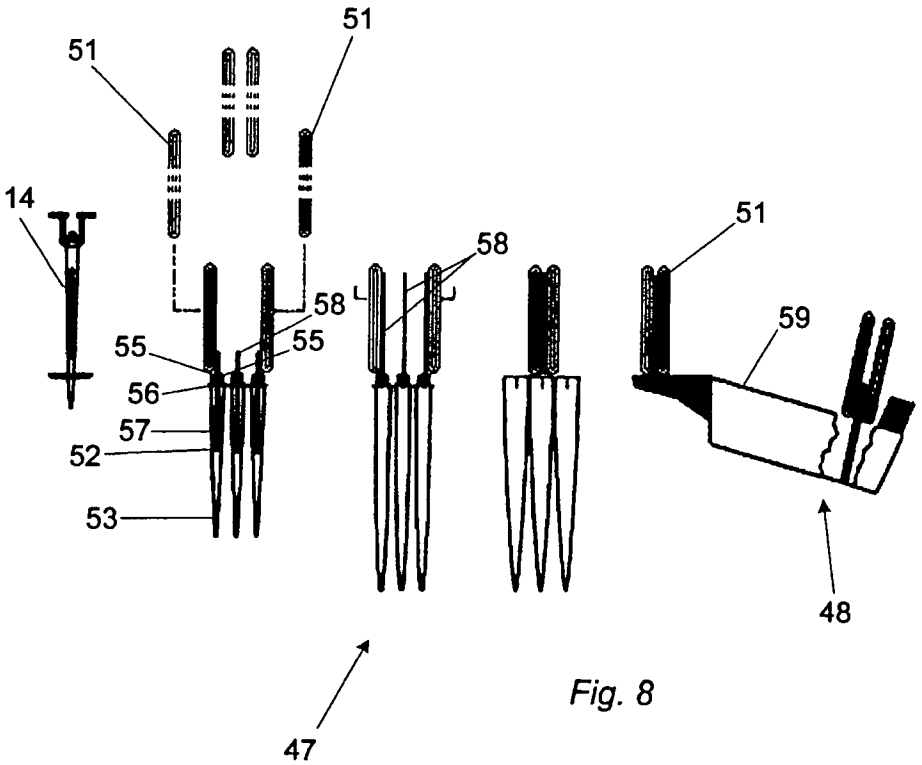
FIG. 8 is a schematic representation of a folder opening and mail traying system according to the invention.

Referring now to FIGS. 1 and 8, traying stations 46 include an opener section 47 and a tray loading area 48 downstream from it. Opener 47 takes a group of vertically positioned holders 14 out of tote 13 and loads the holders onto a pair of rails 56. A pair of belted support paddles 51 are positioned at either end of the row of holders 14. In this embodiment, each holder 14 is essentially a bag that has been doubled over the holder support rails 55 to form a double-walled pocket 57. As shown in FIG. 4, each pocket 57 has a pair of inner and outer bars 52, 53 at the bottom of each layer. At the unload station each end of the pocket 57 support rails 55 are held with a spring loaded gripper. Inner bar 52 is held in place at each end with stationary end effectors. An end effector engages the outer bar 53 that joins lower ends of the double-walled holders 14 to pull the outer walls down. This causes the outer layer of pocket 57 to withdraw downwardly. The inner portion of pocket 57 is peeled away from the mail piece 58 as its sides pass over and around the rails 55. This peeling motion of the outer walls opens the holder so that mail piece 58 does not slide relative to the adjoining walls of the pocket 57. The bottom edge of the mail piece remains stationary or registered as the pocket 57 is peeled away. As the mail piece exits the holder 14, paddles 51 are positioned to support the stack of mail pieces 58 from either end and sweep the mail into an adjoining tray 59. The belts on paddles 51 are driven to lower the mail into the tray 59. To return holder 14 to its original position, a pusher mechanism with a plurality of pushing members, one for each holder 14, engages inner bar 52 of holder 14 and pushes it down, drawing outer bar 53 up and restoring holder 14 to its original doubled-over condition. Empty holders 14 are then returned to rail 15 by reloading them into totes 13 and transporting them to a holder induction station 71, after which totes 13 are returned by conveyor 11 to positions in tote loader 26.

Figure 9:
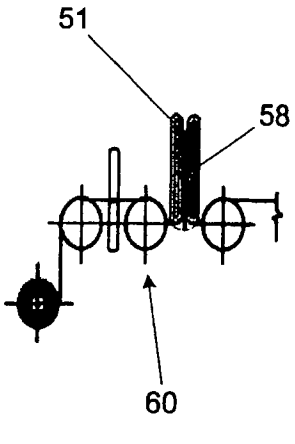
FIG. 9 is a schematic representation of a mail packaging system as an alternative to traying in FIG. 8.

Once paddles 51 have delivered mail pieces 58 to the tray 59, they return as shown to the opener section 47 to start opening the next set of holders 14. As an alternative to unloading into a tray, the belts of paddles 51 are driven to lower the batch of mail 58 into a delivery point packaging system 60 (FIG. 9) such as is described in commonly assigned U.S. Patent Publication 20070017855, Jan. 25, 2007, the contents of which are incorporated herein by reference.

Figure 10:
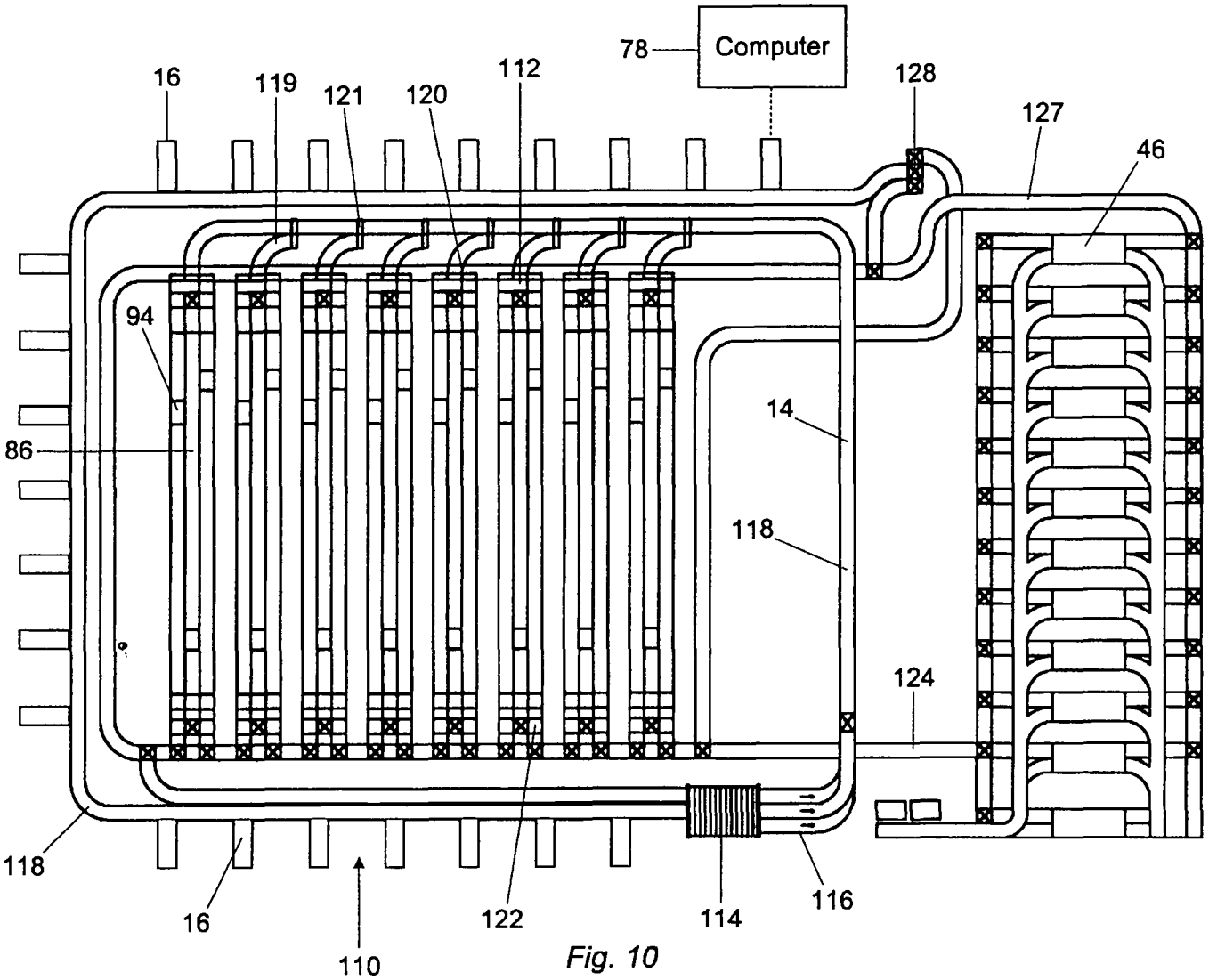
FIG. 10 is a schematic representation of an alternate mail sorting system according to the invention.
Figure 11:
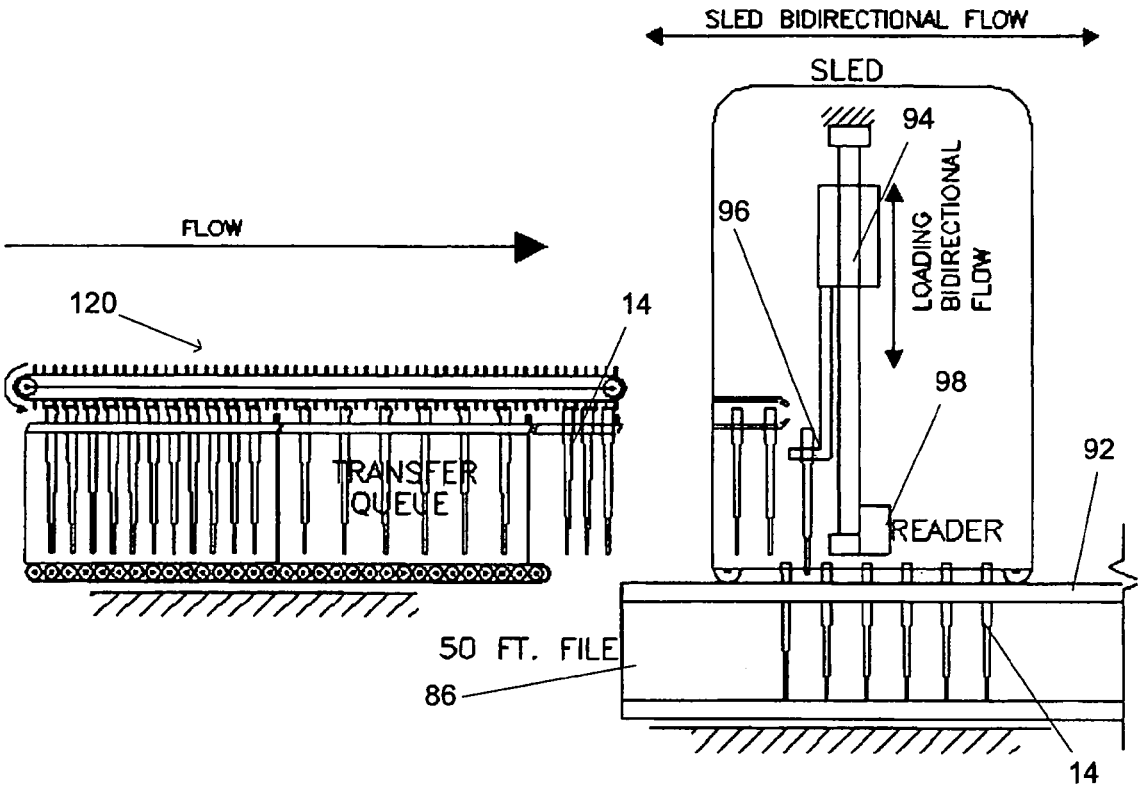
FIG. 11 is a schematic representation of a transfer station and linear sorting lane suitable for use in connection with the mail handling system of FIG. 10.

Referring now to FIGS. 10 and 11, in an alternate embodiment, a mail handling system 110 according to the invention utilizes a plurality of sort lanes 86 each with a sled or robot 94 to order holders 14. Mail pieces are manually loaded into holders 14 at loading stations 16 as described above. Holders 14 are conveyed from manual loading stations 16 to an induction station 112 without being loaded in totes 13. Holders 14 are conveyed from manual loading stations 16 to a splitter 114 which transfers the holders to one of six vertically stacked lanes 116. Each of lanes 116 is provided with a brush conveyor 118 which carries holders 14 to the associated level of one of eight induction stations 112 where the holders 14 are loaded onto a transfer station 120. For this purpose, each lane 116 has eight adjoining branch conveyors 119 each provided with right angle transfer mechanisms 121 to divert holders 14 to the correct induction station 112.

Each of sort lanes 86 is similar to an elongated file cabinet drawer including elongated support rails 92 made of a low friction material and configured to support a large number of holders 14. Holders 14 are picked from the end of the queue at transfer station 120 by a sled or robot 94 suspended by an overhead suspension system and equipped with one or more extendable arms 96 configured to engage and lift the holders 14. Sled 94 is equipped to travel back and forth along the length of the sort lane 84 to place holders 14 in order according to the predetermined sort scheme. Sled 94 is provided with one or more bar code readers 98 for reading the bar codes picked from holders picked from the queue at transfer station 120 and the bar codes of holders 14 in place in sort lane 86. Sled 94 may also be equipped with a sensor to determine its position along the sort lane 86.

In order to place the holders in order according to the predetermined sort scheme, sled 94 picks up a holder 14 from the end of the queue and reads the bar code of the holder. Sled 94 then travels along sort lane 86, reading the bar codes of individual holders 14 already in place in the lane. In a simple version, when sled 94 passes two consecutive holders 14 having bar codes between which the holder 14 carried by sled 94 should be inserted, the sled stops and inserts the holder. Thus, by way of example, if the sort scheme is carrier delivery order and sled 94 is carrying a holder with a mail piece addressed to 2915 Maple St., when sled 94 passes consecutive holders in sort lane 86 having mail pieces addressed to 2909 Maple St. and 2919 Maple St., sled 94 will stop and place the carried holder between the two holders in the sort lane. In an alternate embodiment, lane 86 is subdivided into a series of sections each associated with a range of destinations for the sort scheme. Before scanning individual holders, sled 94 moves to the start of the section where that holder will be placed based on the address of the mail piece inside it.

The computer implemented logic or algorithm controlling led 94 may be stored on an onboard processor or in control computer 78. The algorithm may record the identification number of each holder 14 placed in sort lane 86 and the holder's position in the lane by physical location along the lane and/or relative to other holders in the lane. This information may be transmitted to control computer 78.

Once sorting is completed, ordered holders 14 are then loaded onto totes 13 at loading stations 122 and conveyed to traying station 46 via roller conveyor system 124. Sled 94 is used to push holders 14 into totes 13. Empty totes 13 unloaded at station 46 are then transported along the return portion 127 of conveyor 124 back to loading stations 122. Optionally, totes 13 unloaded at station 46 are reloaded with empty holders 14 and then transported along the return portion 127 to an induction station 128 wherein the empty holders 14 are unloaded onto a brush conveyor for re-use. Totes 13 can also be used to carry empty holders 14 for unloading into either of stations 112 or 122, where empty holders 14 are then unloaded into lanes 86 for storage.

The foregoing embodiment may alternatively use totes 13 for both the loading and unloading process as described in connection with FIG. 1. Direct loading of holders 14 into the sort lanes 86, without first loading and unloading into totes 13, simplifies the process and apparatus in situations where the components of the system can be deployed close to one another as shown.

Figure 12:
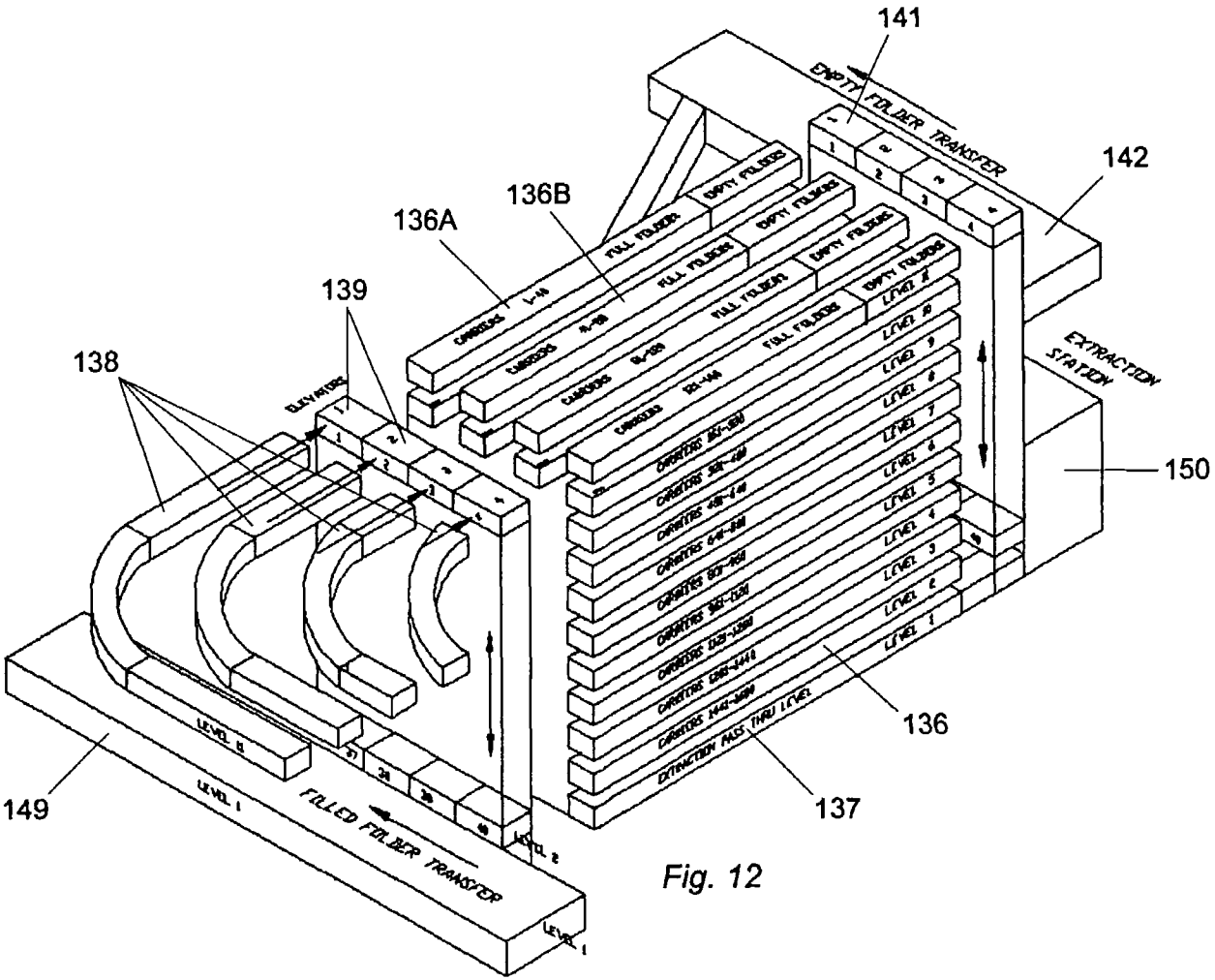
FIG. 12 is a schematic diagram of a two-pass sorting embodiment of the invention.
Figure 13:
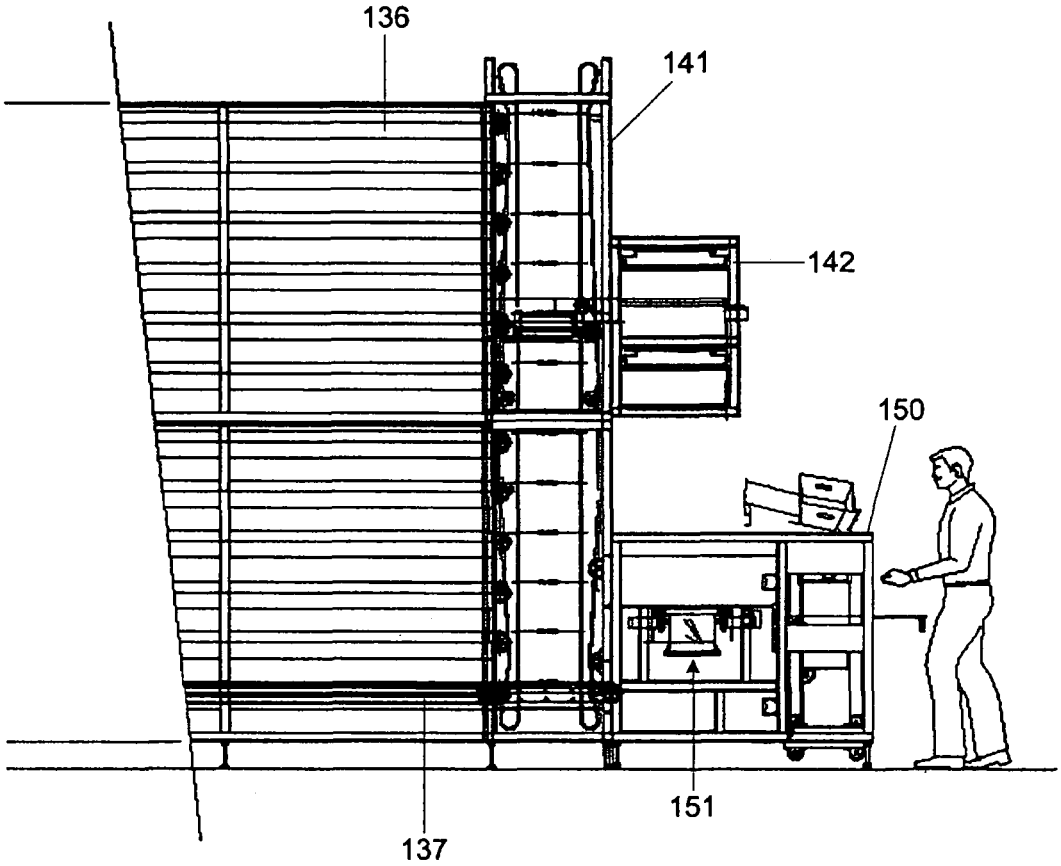
FIG. 13 is a partial side view of the system of FIG. 12.

As is well known in the art, two and three-pass sorts can be used to obtain a greater depth of sortation. The system of the invention can be adapted to perform multi-pass sorts by providing for unloading and recirculation of the stored holders/folders through the conveyor(s) and splitter(s) using different sort logic on the second pass. The embodiment shown in FIGS. 12-13 illustrates a system for accomplishing a two pass sort.

In this embodiment, a total of forty sort lanes 136 are arranged in four rows and ten columns as shown. A bottom, eleventh level is used to provide four extraction pass through lanes 137. Forty folder transfer conveyors 138 transport folders filled at the loading stations through one or more splitters to one of forty associated elevators 139. Elevators 139 are configured to support each folder on rails and move it vertically to any one of the ten sort lane levels 136 or one of the bottom pass through lanes 137. Elevators 139 and lanes 136, 137 are provided with pairs of bidirectional conveyor belts that are used as rails on which the hangers of the folders depend, allowing the entire contents of the lane or elevator to move in either direction.

At the start of a sorting run, empty folders stored at the far end of each lane 136 are removed and circulated to the loading stations. A set of takeaway elevators 141 is provided at the opposite ends of the sort lanes 136 for removal and transfer of empty folders into the associated compartment of takeaway elevator 141 to an empty folder transfer conveyor 142. Transfer conveyor 142 presents an empty tote 13 that receives a group of empty folders from elevator 141.

Mail in folders traveling along conveyors 138 is sorted into sort lanes 136. Upon completion of the first sorting pass, the folders in each sort lane 136 are in this example broken down (sorted) by carrier group, but are not in carrier order. A first lane 136A corresponds to carriers 1-40, a second lane 136B corresponds to carriers 41-80, and so on until the last lane for carriers 1441 to 1600. A second sorting pass then begins.

By means of the conveyor belts associated with the sorting lanes 136, filled folders in first lane 136A are unloaded back out onto elevator 139. Elevator 139 transports batches of filled folders down to a filled folder transfer conveyor 149, which recirculates them through the sorting system. The label on the folder is re-scanned and the folder is sorted using the splitter (s) to one of the forty transfer conveyors 138. This time, the conveyor 138 is selected by carrier. Thus, mail for carrier #1 in the example above would be sent to conveyor 138A, mail for carrier #2 would be sent to conveyor 138B, and so on to carrier #40.

The folders containing mail pieces are allowed to accumulate in conveyors 138 until the entire sorting lane 136A has been emptied of mail-filled folders (empty folders may remain). At that point, the folders from the first conveyor 138A are loaded into the associated elevator 139 and transported, all at once or in groups, to the adjoining extraction pass through lane 137. Lane 137 transports the mail to an extraction station 150 passing below elevator 141. Upon reaching the extraction station 150, the folders may be taken and loaded for extraction manually by a human operator or lifted using an elevator built into station 150 and automatically loaded into an extractor 151 that extracts each mail piece from the folder. Extractor 151 operates based on the same general principle as described above for opener section 47.

The operator then stacks the extracted mail into a tray for later manual casing (sorting) by the carrier into delivery order. The foregoing process is repeated for the remaining thirty nine lanes 138 until all of the mail has been sorted by carrier, extracted and trayed. Empty folders are loaded back onto the return conveyor 142 and sent to lanes 136 where they are stored until the next sorting run. A multi-pass system such as the foregoing may take longer to process the mail, but can be built more compactly than the systems of the previous embodiments.

References to a control computer herein include a variety of known control strategies ranging from a single, centralized control computer that monitors and controls all aspects of the sorting process to distributed control schemes wherein a number of computers or microcontrollers monitor and control different stages of the sorting process and communicate as needed (such as through a local area network) to execute the overall sort scheme. The sort scheme is question will usually be one that takes an incoming batch of mail addressed to a common zone such as a 5-digit zip code and sorts it by destination with batches of mail to each destination in carrier delivery order. However, other sort schemes could be used as well. These batches then are eventually merged (physically matched up with) the corresponding batches of mail sorted by normal machine processing. This merging step is done manually as discussed in the background above.

While certain embodiments of the invention have been illustrated for the purposes of this disclosure, numerous changes in the method and apparatus of the invention presented herein may be made by those skilled in the art. For example, tote loaders 26 could be used in the embodiment of FIGS. 10-11 if it were necessary to transport the holders a substantial distance to reach the sorting lanes 86. If the different components of the system can be built physically close to one another, the use of totes 13 can be omitted entirely. Such a system could resemble that described in connection with FIGS. 10 and 11, except that instead of unloading the holders from the sorting lanes 86 into totes, the opener 47 and tray loader 48 are located on the exit side of each sorting lane 86. Sled 94 is used to unload batches of holders 14 directly to opener 47, which then operates as described in connection with FIG. 8. These and other variations are embodied within the scope and spirit of the present invention as defined in the appended claims.

The invention claimed is:

1. A method for sorting mail pieces, comprising:

loading a batch of mail pieces to be sorted into individual holders;

sorting the holders using an automated sorting system that reorders the holders so that the holders are ordered according to a sort scheme for the mail pieces contained in holders;

storing the sorted holders in a storage area during sorting; and then unloading the mail pieces from the holders in order according to the sort scheme.

2. The method of claim 1, further comprising unloading the sorted holders from the storage area and transporting the holders to an unloading station at which the unloading step is carried out.

3. The method of claim 1, wherein the holders comprise folders each having a machine readable label that is associated during sorting with the mail piece contained in the folder.

4. The method of claim 3, wherein the folders have hanger portions by which the folders are suspended from rails during the sorting step.

5. The method of claim 1, wherein the sorting and storing steps further comprise:

sorting the holders into the storage area using first pass sort scheme logic;

removing the holders from the storage area and recirculating the holders to the automated sorting system; and then re-sorting the holders using second pass sort scheme logic.

6. The method of claim 1, wherein the sorting step comprises:

passing the holders along a conveyor to a splitter;

determining destination information for the mail piece contained in a holder entering the splitter;

operating the splitter to route the holder to one of several takeaway conveyors; and transporting the holder to a section of the storage area associated with that takeaway conveyor.

7. The method of claim 1, wherein the sorting step comprises:

passing the holders along a conveyor to a splitter;

determining destination information for a mail piece contained in a holder entering the splitter; and operating the splitter to shift the holder from the conveyor to one takeaway conveyor of a plurality of takeaway conveyors based on the destination information.

8. A method for sorting mail pieces, comprising:

sorting a majority of the mail pieces using an automated sorting system;

sorting residual mail not sortable on the automated sorting system by loading the residual mail pieces into individual holders, sorting the holders using an automated system that reorders the holders so that the holders are ordered according to a sort scheme for the mail pieces, contained in the holders, then unloading the mail pieces from the holders in order according to the sort scheme; and merging the mail pieces sorted with the automated sorting system with the sorted residual mail.

9. The method of claim 6, wherein the holders comprise folders.

10. The method of claim 8, wherein the sorting the holders step comprises:

passing the holders along a conveyor to a splitter;

determining destination information for a mail piece contained in a holder entering the splitter; and operating the splitter to shift the holder from the conveyor to one takeaway conveyor of a plurality of takeaway conveyors based on the destination information.

11. A method for sorting mail pieces, comprising:

loading a batch of mail pieces to be sorted into individual holders;

sorting the holders using an automated sorting system that reorders the holders so that the holders are ordered according to a sort scheme for the mail pieces contained in the holders, wherein the sorting is performed using destination information for each mail piece and corresponding bar codes on each holder;

storing the sorted holders in a storage area during sorting; and then unloading the mail pieces from the holders in order according to the sort scheme.

12. The method of claim 11, further comprising unloading the sorted holders from the storage area and transporting the holders to an unloading station at which the unloading step is carried out.

13. The method of claim 11, wherein the holders comprise folders each having a machine readable label that is associated during sorting with the mail piece contained in the folder.

14. The method of claim 11, wherein the sorting and storing steps further comprise:

sorting the holders into the storage area using first pass sort scheme logic;

removing the holders from the storage area and recirculating the holders to the automated sorting system; and then re-sorting the holders using second pass sort scheme logic.

15. The method of claim 11, wherein the sorting step comprises:

passing the holders along a conveyor to a splitter;

determining destination information for the mail piece contained in a holder entering the splitter;

operating the splitter to route the holder to one of several takeaway conveyors; and transporting the holder to a section of the storage area associated with that takeaway conveyor.

16. The method of claim 11, wherein the sorting step comprises:

passing the holders along a conveyor to a splitter;

determining destination information for a mail piece contained in a holder entering the splitter; and operating the splitter to shift the holder from the conveyor to one takeaway conveyor of a plurality of takeaway conveyors based on the destination information.

* * * * *